United States Patent [19]

Liller

[11] 4,157,295

[45] Jun. 5, 1979

[54] METHOD AND APPARATUS FOR TESTING AND SEPARATING MINERALS

[76] Inventor: Delbert I. Liller, Rte. 4, Box 64, Deer Park, Md. 21550

[21] Appl. No.: 860,331

[22] Filed: Dec. 14, 1977

[51] Int. Cl.[2] ..... B03B 1/04; B03B 5/40

[52] U.S. Cl. ..... 209/5; 209/17; 209/172

[58] Field of Search ..... 209/172, 5, 172.5, 173, 209/17

[56] References Cited

U.S. PATENT DOCUMENTS

| | | | |
|---|---|---|---|
| 995,853 | 6/1911 | Felsing | 209/173 |
| 1,839,117 | 12/1931 | Nagelvoort | 209/172 |
| 2,132,484 | 10/1938 | Kober | 209/172 |
| 2,861,688 | 11/1958 | Harms | 209/17 X |

*Primary Examiner*—Ralph J. Hill

*Attorney, Agent, or Firm*—Abraham A. Saffitz

[57] ABSTRACT

A sink-float method and apparatus for testing and separating a mineral such as coal in mineral products containing inert matter which employs a novel trapezoidally shaped testing tank, a mixture of perchloroethylene as a parting liquid and white gasoline as a dispersant and surfactant, and an implement in the form of a long stirring rod angulated at its end. The tank is provided with bars at the bottom to limit the movement of the implement. The invention provides a quick and precise test for specific gravity of raw crushed coal and its impurities.

4 Claims, 8 Drawing Figures

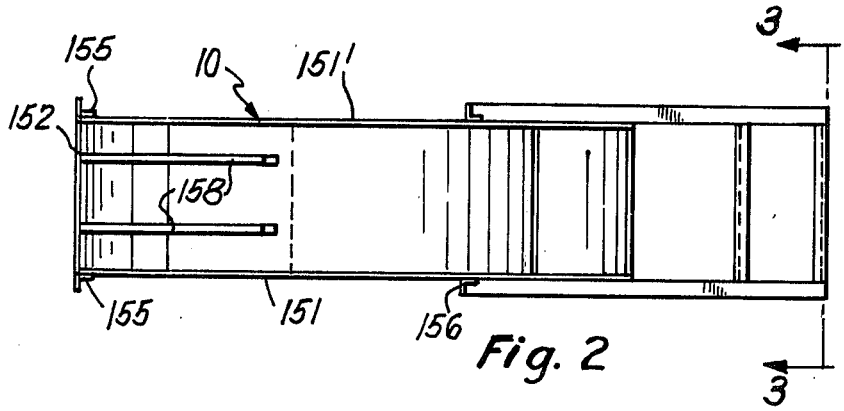
Fig. 2
Fig. 1
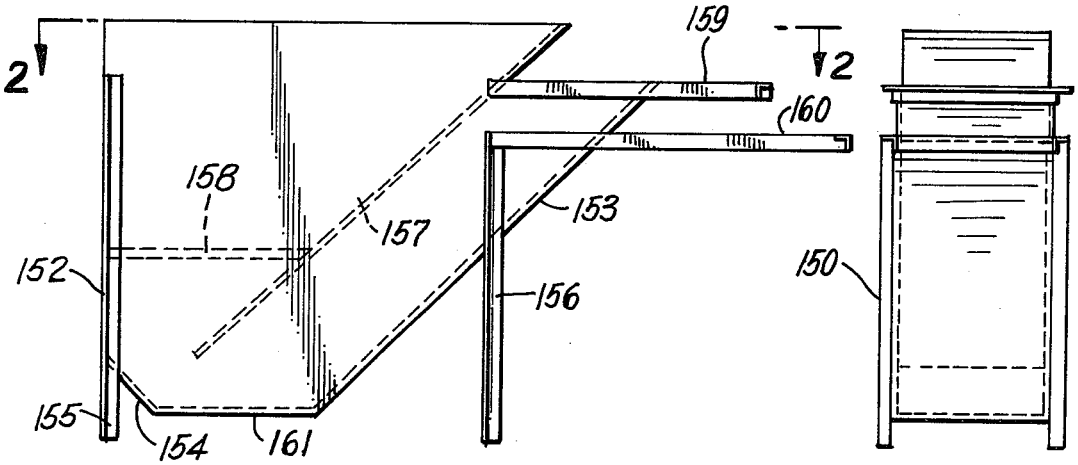
Fig. 3
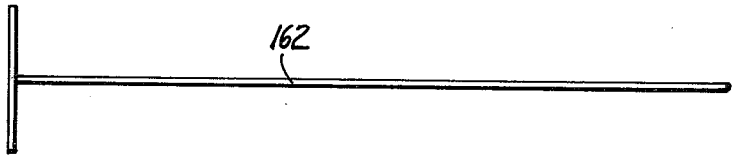
Fig. 4
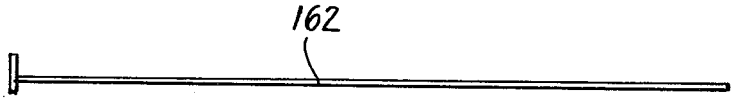
Fig 5
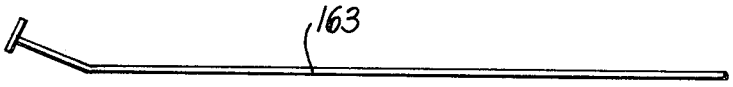
Fig 6

$C_L$ - Floats
$R_h$ - Sinks

METHOD AND APPARATUS FOR TESTING AND SEPARATING MINERALS

CROSS REFERENCE TO RELATED APPLICATIONS

Reference is made to the following copending application Ser. No. 860,330 filed Dec. 14, 1977:

| Case No. | Title |
|---|---|
| 1 | Inlet Line Deflector and Equalizer Means for A Classifying Cyclone Used for Washing and Method of Washing Using Deflectors and Equalizers |

BACKGROUND OF THE INVENTION

1. Field of the Invention

This invention lies in the general field of sink float apparatus and methods for separating particles of solids of different densities.

2. Brief Description of the Prior Art

The prior art relevant to the present invention is summarized below:

| Patent | Issue Date | Teaching |
|---|---|---|
| 2,150,946 | March 21, 1939 | Shows drum apparatus used in classification system |
| 2,266,840 | Dec. 23, 1941 | Method and apparatus for determining percentage of coal in mineral products |
| 2,670,078 | Feb. 23, 1954 | Float-sink separation; uses chlorinated hydrocarbon |
| 3,101,312 | Aug. 20, 1963 | Sink separators arranged in series so that minerals and coal of different particle size can be worked up |
| 3,122,498 | Feb. 25, 1964 | Preparation and transportation of fine coal for cleaning on concentrating tables |
| 3,348,675 | Oct. 24, 1967 | Sink float process for separating solids of different densities; uses parting liquid halogenated hydrocarbon and adds ionic dispersant |

DISTINCTIONS OVER THE PRIOR ART

Although the prior patent art has provided a number of approaches to the classification and testing of minerals and recognizes the need for a simple problem to separate impure crushed minerals into fractions, a great variety of tanks have been suggested.

U.S. Pat. No. 2,150,946 uses a complicated drum as shown in FIG. 5. U.S. Pat. No. 2,266,840 shows a trough. U.S. Pat. No. 2,670,078 shows a horizontal tank. U.S. Pat. No. 3,101,312 also shows a horizontal tank with scoops disposed around the inner periphery. U.S. Pat. No. 3,122,498 shows a sluiceway.

The tank and stirring implement of the invention uniquely provide an inner shortened oblique separating wall which is parallel to the outer trapezoidal wall at an angle of 135 degrees to facilitate movement of heavies and middlings around the bottom edge, wholly within the tank, to form a lower receptacle portion at the bottom of the tank under the edge for the collection of heavies on the side of the separating wall next to the outer trapezoidal wall of the tank. Bars forming a grid at the bottom restrain the stirring implement so that stirring the sample serves to restrain the movement of light fractions of the sample in the liquid in the tank. The heavies are pushed against other heavies from a location above the bottom edge of the lights side of the separating wall. While U.S. Pat. No. 2,266,840 shows a trough like container using a heavy chlorohydrocarbon, the apparatus in this patent cannot separate and test coal or similar ore as efficiently or rapidly as the invention because of the provision of a separating wall at a critical distance between the bottom edge of the separating wall and the flat bottom portion of the tank.

SUMMARY OF THE INVENTION

The present invention relates to an apparatus and method for determining the content of a valuable mineral such as coal in a mineral product which may contain inert matter in varying amounts such as clay, pyrite slate, rocks, ash, etc., and more particularly to a superior testing tank and improved process for separating materials by means of a parting liquid having a density or specific gravity intermediate those of the materials to be separated.

In illustrating the apparatus and method reference will be made to coal and inert matter found when mining coal, but it should be understood that the use of the method and apparatus to determine the content or percentage of coal in the mineral product is merely illustrative, and both apparatus and method are equally applicable for determining the percentage of any other naturally occurring mineral product such as an ore or mineral mixture.

The apparatus as illustrated is particularly adapted for use in connection with mineral separation wherein clean coal is separated from relatively heavy inert matter and from middlings. The term "middlings" in mineral separation practice involving flotation methods means that product intermediate in density between the lighter fraction such as coal, which has a decided tendency to float, and the relatively heavier fraction such as rocks which have a definite tendency to sink. Separation of material of different densities by sink-float means is well known. One of the problems encountered in sink-float separations is that of floc formation formed by the inert matter which interferes with the separation and the yield, and thus reduces the accuracy of the determination of the clean coal content.

OBJECTS OF THE INVENTION

An object of this invention is, accordingly, the provision of an improved and simple apparatus employing a more effective and novel method for the determination of the coal content or percentage of coal in a mineral product, or the percentage of inert or undesirable material in any valuable mineral of which coal is an example.

A further object of the present invention is to provide an improved sink-float process with improved dispersion, whereby floc-formation is reduced to a minimum or eliminated, thus improving process yield.

A further object of the invention is to provide a superior and unique test tank provided with means for enabling determination of the contents of coal in a mineral product. These and still further objects and advantages of the invention will be apparent from the ensuing disclosure of a preferred embodiment thereof.

BRIEF DESCRIPTION OF THE DRAWING

Referring to the drawing, FIG. 1 represents a view in elevation of the novel testing tank for accomplishing the objects noted. FIG. 2 is a top view of the testing tank taken on line 2—2 of FIG. 1 and looking in the direction denoted by the arrows. FIG. 3 is an end elevation view of the testing tank taken on line 3—3 and looking in the direction of the arrows. FIGS. 4 and 5 are top and side views, respectively of a stirring rod. FIG. 6 is a side view of a modified stirring rod.

DESCRIPTION OF THE PREFERRED EMBODIMENT

Figure 7:
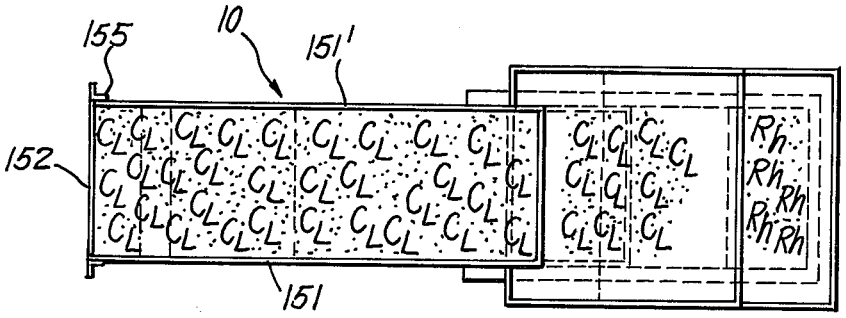
FIGS. 7 and 8 show the operation.
Figure 8:
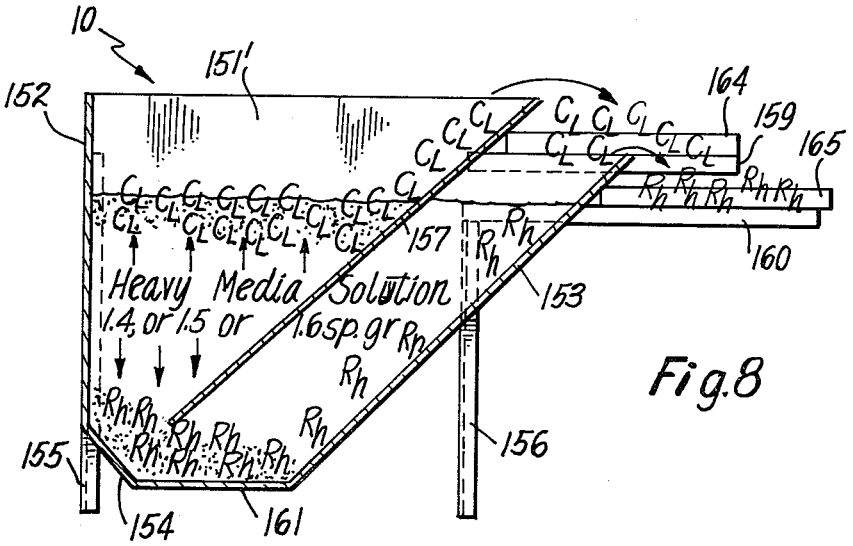

In the above described figures of the drawing, the numeral 10 indicates a testing tank made preferably of chemical resistant metal, open at the top and having generally parallel trapezoidal side members 151 and 151', a vertical rectangular end member 152, an opposing rectangular end member 153 at approximately 135° to the horizontal bottom member 161, and a narrow rectangular bottom member 154 at approximately 135° to member 161, at 45° to vertical end member 152. The interior of the testing tank 10 is constructed with a plurality of bars 158 forming a grid below the mid section, and a baffle plate 157 parallel to end member 153. A top pan support 159 and a bottom pan support 160 are mounted adjacent the baffle plate 157 and end member 153. The entire tank assembly is supported by front legs 156 and rear legs 155 in the form of angle bars for supporting the tank assembly on a horizontal surface.

In utilizing the testing tank 10 to determine the content of a valuable mineral such as clean coal in a mineral product, a weighed sample to be tested is placed in the testing tank. A preferred heavy parting liquid of known specific gravity, such as perchloroethylene is mixed with a dispersant of soluble lead free gasoline such as AMOCO "white" gasoline. The dispersant is usually added to and mixed with the parting liquid in an amount sufficient to provide the desired dispersion. Generally, an amount of dispersant of from about 1.5 to about 13.4 percent by weight of parting liquid is desirable. It is essential that the entire mixture of minerals, perchloroethylene and dispersant be thoroughly mixed. To provide thorough mixing and because the perchloroethylene mixture has toxic or poisonous characteristics, a long stirring rod 162 is provided. It is also desirable that the middlings shall be separated for further breaking in order to extract coal and that the sinks and floats can be removed separately and placed on the pan supports for analysis. It will be noted that the grid formed by bars 158 limit the travel of the stirring rod 162 and that baffle plate 157 provides a convenient means for removing clean coal on to the top pan support 159. The modified stirring rod 163 may be angulated adjacent its end portion to facilitate this process.

PREPARATION OF HEAVY PARTING LIQUIDS

The heavy parting liquids for specific gravity of 1.6, 1.5 and 1.4 which are used in the preferred embodiment of a trapezoidally shaped testing tank are based upon perchloroethylene containing between about 1.5% by weight up to about 13.4% by weight of "white" gasoline, e.g., lead free gasoline, as dispersant.

The testing tank of the invention which has been sucessfully employed with 100 pound samples of crushed raw coal is about 1 foot wide, 4 feet long and 3 feet high.

A 1.6 gravity testing liquid is made by mixing 19.33 gallons of perchloroethylene and 0.67 gallons of white gasoline. This is 1.52% gasoline and 98.48% perchloroethylene by weight.

A 1.5 specific gravity testing liquid is made by mixing 92.97 parts by weight of perchloroethylene and 7.03 parts by weight of white gasoline.

A. 1.4 specific gravity testing liquid is made by mixing 86.62 parts by weight of perchloroethylene and 13.38 parts by weight of white gasoline.

EXAMPLE 1

The estimated specific gravity setting comes from a comparison of clean coal quality to coal quality from a washability. A washability is run on a coal sample from the raw coal being processed. The coal sample is washed in solutions of different specific gravity.

PROCEDURE

A known quantity of coal (100 pounds preferably) is first placed in a 1.6 specific gravity solution. The material is agitated vigorously, let to stand for 5 to 10 minutes, and skimmed off. These floats are then placed in a 1.5 specific gravity solution, agitated vigorously, let to stand for 5 to 10 minutes, and skimmed off. These floats are placed in a 1.4 specific gravity solution and the same procedure is repeated. The 1.4 specific gravity floats are placed in a dryer. The materials that sank in each solution are pulled out, labeled, and dried.

After drying is complete, the fractions of the sample are weighed and analyzed. The original sample has now been divided into four known fractions: 1.6 specific gravity sinks, 1.6 to 1.5 specific gravity sinks, 1.5 to 1.4 specific gravity sinks, and 1.4 specific gravity floats.

The fractions can now be mathematically put back together to give a total composite of 1.6 specific gravity floats, 1.5 specific gravity floats, and 1.4 specific gravity floats. This is the information necessary to know what specific gravity the plant should be set at. It gives the quality and the percent of recovery to be expected from the plant.

A test run of this procedure is given in Example 2 below.

EXAMPLE 2

Test Run of Washability of Bone Pile Shaker Coal

A sample was taken from a pile of bone pile shaker coal which was crushed to ¾×0 raw coal. The analysis was as follows:

| As Received | | Dry Basis | |
|---|---|---|---|
| M | 4.19 | | |
| A | 26.13 | A | 27.27 |
| S | 0.66 | S | 0.69 |
| BTU | 9656 | BTU | 10078 |
| M&A Free | 13856 | | |
| FSI | 0 | | |

The washability was run by the above procedure to give the following four fractions:

| | | | | |
|---|---|---|---|---|
| Fraction 1 | | | ¾ × 0 | |
| | | | 1.6 Sinks | |
| Recovery | 28.64% | | A | 71.97 |
| | | | S | 0.52 |
| | | | BTU | 2719 |
| | | M & A FREE | BTU | 9701 |
| | | | FSI | 0 |
| Fraction 2 | | | ¾ × 0 | |
| | | | 1.6 Floats | |
| | | | 1.5 Sinks | |

-continued

| | | | | |
|---|---|---|---|---|
| Recovery | 2.38% | | A | 55.47 |
| | | | S | 0.70 |
| | | | BTU | 5225 |
| | | M & A FREE | BTU | 11733 |
| | | | FSI | 0 |
| Fraction 3 | | | ¾ × 0 | |
| | | | 1.5 Floats | |
| | | | 1.4 Sinks | |
| Recovery | 6.46% | | A | 25.39 |
| | | | S | 0.69 |
| | | | BTU | 10444 |
| | | M & A FREE | BTU | 13998 |
| | | | FSI | 0 |
| Fraction 4 | | | ¾ × 0 | |
| | | | 1.4 Floats | |
| Recovery | 62.53% | | A | 9.03 |
| | | | S | 0.89 |
| | | | BTU | 13792 |
| | | M & A FREE | BTU | 15161 |
| | | | FSI | 1 |

The washability for the recovery of the combined fractions of specific gravities of 1.6, 1.5 and 1.4 is then combined mathematically with the result as shown below:

| $X_1$ 1.6 Specific Gravity Cut | | | | |
|---|---|---|---|---|
| | | ¾ × 0 Combined 1.6, 1.5, 1.4, Floats | | |
| Recovery | 71.37% | | A | 12.06 |
| | | | S | 0.87 |
| | | | BTU | 13203 |
| | | M & A FREE | BTU | 15014 |
| | | | FSI | 1 |

To permit the operator to make a selection between the combination of the three fractions, 1.6+1.5+1.4 as against the combination of 1.5 and 1.4, the following mathematical combination is made:

| $X_2$ 1.5 Specific Gravity Cut | | | | |
|---|---|---|---|---|
| | | ¾ × 0 Combined 1.5 & 1.4 Floats | | |
| Recovery | 68.99% | | A | 10.56 |
| | | | S | 0.87 |
| | | | BTU | 13479 |
| | | M & A FREE | BTU | 15070 |
| | | | FSI | 1 |

In the above, the following are the ASTM abbreviations, all percentage by weight:

| | | |
|---|---|---|
| M | = | moisture |
| A | = | ash |
| S | = | sulphur |
| BTU | = | ASTM BTU Test, as is basis |
| M & A Free | = | BTU on moisture and ash free basis |
| FSI | = | coking quality ASTM Free Swelling Index |

The sampling and test results of washability in Example 2 are particularly useful in Cases 1, 3 and 4 which are set out in Cross References to Related Applications on the first page hereof. These 3 copending applications are especially designed for washing coal.

By this invention there is provided a highly practical and simple apparatus and method for the separation and analysis of coal from inert matter or impurities, and in general of solids from other solids of different specific gravity.

As many apparently widely different embodiments of the invention may be practiced without department from the spirit and scope thereof, it is to be undestood that, within the scope of the appended claims, the invention may be practiced otherwise than as specifically illustrated and described according to the provisions of the Patent Statutes.

I claim:

1. A mineral separating apparatus comprising:

an open top test tank adapted to contain a bath of heavy parting liquid mixed with lead free gasoline and a crushed mineral product, said tank having generally parallel trapezoidal side members;

a vertical rectangular end member;

an opposing rectangular end member at approximately 135 degrees to a horizontal first bottom member;

a rectangular second bottom member at approximately 45 degrees to said vertical end member;

the interior of said tank being provided with bars forming a grid;

a baffle plate parallel to said opposing end member;

the bottom edge of said baffle plate being spaced from the bottom to permit heavy fractions of the crushed mineral to be pushed under the edge, the mineral being pushed from the angular second bottom member toward the trapezoidal side member in a second compartment formed between the baffle and the trapezoidal side member; and a plurality of pan supports being mounted adjacent said baffle plate for fractions of said mineral product.

2. The apparatus of claim 1 wherein said tank is provided with means for supporting said tank on a horizontal surface.

3. In a sink-float separation process wherein finely divided solid mineral materials tend to form flocs due to inert matter therein and which contains a plurality of components of different densities and specific gravities are separated by employing a parting liquid of perchloroethylene of intermediate density or specific gravity with respect to said solid materials, the improvement which comprises providing lead free gasoline as a dispersant in an amount of about 1.5% to about 13.4% by weight of the mixture of perchloroethylene and gasoline and said white gasoline serving as the sole surfactant soluable in said parting liquid; and thereafter mixing with a stirring rod to distribute said solid materials in a trapezoidally shaped testing tank fitted with a baffle for the purpose of separating sinks from floats, the sinks being pushed under the baffle to a heavy side of the tank and away from the floats whereby floc-formation is reduced to a minimum.

4. A process as claimed in claim 3 wherein said stirring rod is provided with an angulated end which prevents pushing lights under the baffle to the heavy side of the tank.

* * * * *